US011624218B2

(12) United States Patent
Guerin et al.

(10) Patent No.: US 11,624,218 B2
(45) Date of Patent: Apr. 11, 2023

(54) ELECTRONIC HANDLE FOR A VEHICLE DOOR AND VEHICLE DOOR

(71) Applicant: U-Shin Italia S.p.A., Pianezza (IT)

(72) Inventors: Anthony Guerin, Pianezza (IT); Massimo Frattini, Pianezza (IT)

(73) Assignee: U-Shin Italia S.p.A., Pianezza (IT)

( * ) Notice: Subject to any disclaimer, the term of this patent is extended or adjusted under 35 U.S.C. 154(b) by 251 days.

(21) Appl. No.: 16/919,663

(22) Filed: Jul. 2, 2020

(65) Prior Publication Data

US 2021/0002930 A1 Jan. 7, 2021

(30) Foreign Application Priority Data

Jul. 3, 2019 (EP) ..... 19184206

(51) Int. Cl.
*E05B 79/06* (2014.01)
*E05B 81/76* (2014.01)
(Continued)

(52) U.S. Cl.
CPC ..... *E05B 85/16* (2013.01); *E05B 77/36* (2013.01); *E05B 79/06* (2013.01); *E05B 81/76* (2013.01); *E05B 81/90* (2013.01)

(58) Field of Classification Search
CPC ..... E05C 17/56; E05B 81/90; E05B 47/0038; E05B 85/10; E05B 79/06; E05B 81/64;
(Continued)

(56) References Cited

U.S. PATENT DOCUMENTS 7,866,714 B2 * 1/2011 Monig ..... E05B 81/76 292/336.3
9,181,732 B2 * 11/2015 Bland ..... E05B 77/42
(Continued)

FOREIGN PATENT DOCUMENTS

DE 102015010626 2/2017
DE 102015010626 A1 * 2/2017 ..... E05B 17/0058
(Continued)

OTHER PUBLICATIONS

Espacenet, Machine Translation of DE102015010626A1, generated May 2, 2022 (Year: 2022).*
(Continued)

*Primary Examiner* — Kristina R Fulton
*Assistant Examiner* — Emily G. Brown
(74) *Attorney, Agent, or Firm* — Burris Law, PLLC

(57) ABSTRACT

An electronic handle for a vehicle door includes a bracket, a grip movably mounted on the bracket between a first position and a second position, the grip configured to move from the first position to the second position when a pulling force is applied on the grip by a user, a magnetic retainer configured to hold the grip in the first position, an electronic system configured to electronically cooperate with a latch for opening the vehicle door when activated in a first configuration corresponding to a normal use, and a back-up system configured to cooperate with the latch for opening the vehicle door when activated in a second configuration corresponding to an emergency or a lack of electrical power. The electronic system is configured to activate in response to a detection of a pulling force applied on the grip that is lower than a predetermined force.

17 Claims, 5 Drawing Sheets

(51) Int. Cl.

| | |
|---|---|
| ***E05B 81/90*** | (2014.01) |
| ***E05B 85/16*** | (2014.01) |
| ***E05B 77/36*** | (2014.01) |

(58) Field of Classification Search
CPC ..... E05B 85/16; E05B 77/36; E05B 81/76; Y10S 292/53; Y10S 292/54
See application file for complete search history.

(56) References Cited

U.S. PATENT DOCUMENTS

| | | | | |
|---|---|---|---|---|
| 11,174,663 | B2 * | 11/2021 | Gerber | E05B 81/90 |
| 2018/0051492 | A1 * | 2/2018 | Smith | E05B 79/06 |
| 2018/0087299 | A1 * | 3/2018 | Okuma | B60J 5/04 |
| 2019/0119958 | A1 * | 4/2019 | Gerber | E05B 85/16 |

FOREIGN PATENT DOCUMENTS

| | | | |
|---|---|---|---|
| DE | 102016014773 | | 6/2018 |
| DE | 102016014773 | A1 * | 6/2018 |
| JP | 2007040084 | | 2/2007 |

OTHER PUBLICATIONS

Dialog, Machine Translation of DE 102016014773A1, generated May 4, 2022 (Year: 2022).*
European Search Report for EP Application 19184206, completed Dec. 16, 2019.

* cited by examiner

ELECTRONIC HANDLE FOR A VEHICLE DOOR AND VEHICLE DOOR

CROSS-REFERENCE TO RELATED APPLICATIONS

This application claims priority to and the benefit of EP 19184206.1, filed on Jul. 3, 2019. The disclosures of the above applications are incorporated herein by reference.

FIELD

The present disclosure relates to an electronic handle for a vehicle door and a vehicle comprising such a handle.

BACKGROUND

The statements in this section merely provide background information related to the present disclosure and may not constitute prior art.

Electronic handles for vehicle doors generally comprise a switch configured to activate a latch mechanism, such as electronic latch, to unlatch the vehicle door.

Some users prefer having an electronic handle with a handle lever configured to be actuated by a user according to a reduced strength with respect to classical mechanical handles, thereby activating the electronic latch mechanism.

Such electronic handles require a battery to be useable. In case of a low battery or a crash, the electronic handle is not useable and it is not possible for a user to enter the vehicle.

Thus, back-up systems are arranged in electronic handles to enable to unlatch the vehicle door. Such back-up systems may be mechanical or electrical. In the case of a mechanical back-up system, the system usually comprises a handle lever cooperating with an activation lever which in turn cooperates with the latch mechanism.

SUMMARY

This section provides a general summary of the disclosure and is not a comprehensive disclosure of its full scope or all of its features.

The present disclosure provides an electronic handle with a back-up system in case of loss of battery, which is efficient and easy for the user to activate.

The present disclosure provides an electronic handle for a vehicle door, the handle comprising a bracket, a grip movably mounted on the bracket between a first position and a second position, the grip being configured to move from the first position to the second position when a pulling force is applied on the grip by a user, a magnetic retainer configured to hold the grip in the first position, an electronic system configured to electronically cooperate with a latch for opening the vehicle door when activated in a first configuration corresponding to a normal use, and a back-up system configured to cooperate with the latch for opening the vehicle door when activated in a second configuration corresponding to an emergency or a lack of electrical power. The electronic system is configured to activate in response to a detection of a pulling force applied on the grip that is lower than a predetermined force and the magnetic retainer is configured to hold the grip in the first position if a pulling force applied on the grip that is lower than the predetermined force and to release the grip and allow a movement from the first position to the second position to activate the back-up system in response to a pulling force applied on the grip that is higher than the predetermined force.

Thanks to the magnetic retainer of the present disclosure, the position of the grip is stabilized relative to the bracket and the vehicle door in the first configuration, in a normal use. Non-esthetic gaps between an external part of the grip and an external surface of the door panel are reduced.

The position of the grip is also stabilized relative to the bracket and the vehicle door in the second configuration when not activated, i.e. during a crash, the door of the vehicle does not open.

Indeed, when the pulling force applied on the grip does not exceed the predetermined force, the movement of the grip is limited and the grip is therefore more stable.

Therefore, in normal operation, the user has a sensation of a firm and stable handle.

After a crash or in case of a lack of electrical power, the user can open the vehicle door by pulling the grip with a force that exceeds the predetermined force.

Therefore, the position of the grip is stabilized during normal use and when not activated but can easily be moved to open the vehicle.

In the first configuration of the present disclosure, the magnetic retainer holds the grip in the first position when a pulling force, lower that the predetermined force, is applied on the grip.

Therefore, in the first configuration, the electronic system is activated without the grip being moved, whereas in the second configuration, the back-up system is activated by the displacement of the grip from the first position to the second position.

Moreover, thanks to the magnetic retainer stabilizing the grip, the number of component of the handle may be reduced, and/or the size of the components may be reduced.

Additionally, the magnetic retainer has no impact on the functional volume of the existing handles.

Another advantage of the present disclosure is that the system can be used on different kinds of handles, for example, a handle whose grip has an axis of rotation extending in the left-right direction or a handle which grip has an axis or rotation extending in a front-back direction, called a swing handle.

The predetermined force corresponds to a magnetic force generated by the magnetic retainer.

The grip may be attached to the bracket at least via the magnetic retainer.

According to at least one form of the present disclosure, the predetermined force is between 50 and 700 Newtons (N), and in another form between 50 and 500N, and in another form between 100 and 200N, and in another form between 125 and 175N, and in yet another form the predetermined force is 150N.

According to a form of the present disclosure, the predetermined force is sufficient to hold the grip in the first position, for example during a crash, but allows the user to easily open the door.

The predetermined force is modified by changing the magnetic retainer's dimensions/performances.

According to one form of the present disclosure, the magnetic retainer comprises a magnetic element, such as a magnet, and a ferromagnetic element. The magnetic retainer is independent from the main battery and holds the grip in the first position. For example, the magnetic element is affixed to the grip and the ferromagnetic element is affixed to the bracket, or vice versa.

When the pulling force is higher than the magnetic force, the magnetic element and the ferromagnetic element move apart from each other, thus allowing the movement of the grip from the first position to the second position.

In the first position of the grip, the magnetic element and the ferromagnetic element are closer to each other than in the second position. According to one form of the present disclosure, in the first position, the magnetic element and the ferromagnetic element are in contact. According to another form of the present disclosure, in the first position, the magnetic element and the ferromagnetic element are directly in contact.

According to one configuration of the present disclosure, the grip comprises an external part, arranged on an external surface of the vehicle door, and a connecting part affixed to the external part, the connecting part affixed to the bracket via the magnetic retainer when the grip is in the first position.

For example, the external part protrudes from the external surface of the vehicle door.

As another example, the external part is flush on the external surface of the vehicle door.

According to yet another form of the present disclosure, the magnetic retainer is disposed the closest to the applied pulling force. The magnetic retainer may therefore be more efficient.

According to other forms of the present disclosure, the grip comprises an internal part affixed to the connecting part, the internal part being rotatably mounted on the bracket, when the grip is moved from the first position to the second position, the internal part rotates relative to the bracket.

For another example, the internal part of the grip is rotatably mounted on the bracket via a pivot bearing.

According to one form of the present disclosure, the back-up system comprises a cable or a rod, attached to the internal part of the grip, and to the latch.

The cable or the rod may be configured to cooperate with the latch to open the door.

An advantage is that the back-up system is activated mechanically and is therefore independent from the main battery of the vehicle.

According to one form of the present disclosure, the grip is configured to move on a stroke between the first position and the second position and wherein the electronic handle comprises at least one spring configured to bias the grip toward the first position over at least a biasing part of the stroke.

Thanks to the at least one spring, when the grip is pulled with a pulling force greater than the predetermined force and starts moving from the first position to the second position, the spring resists the movement of the grip, which improves the sensation of the user.

According to another form of the present disclosure, the biasing part of the stroke extends from the first position.

Therefore, immediately when the grip starts moving from the first position to the second position, the spring is configured to start biasing the grip toward the first position, and therefore improving the sensation of the user.

According to one form of the present disclosure, the biasing part of the stroke extends from an intermediate position of the stroke, the intermediate position being disposed between the first and the second positions.

In this example, the at least one spring is configured not to bias the grip toward the first position over at least a non-biasing part of the stroke, wherein the non-biasing part of the stroke extends from the first position to the intermediate position, and wherein the biasing part of the stroke extends from the intermediate position, i.e. the end of the non-biasing part of the stroke.

In other words, the spring is configured to start biasing the grip toward the first position when the grip has completed at least one part of the stroke between the first position and the second position.

In this example, the sensation of the user is improved by an absence of resistance during the non-biasing part of the stroke, followed by the presence of a resisting force during the biasing part of the stroke.

According to one form of the present disclosure, the electronic handle comprises an additional spring configured to bias the grip toward the first position over at least an additional biasing part of the stroke, wherein the additional biasing part of the stroke extends from the first position or from an additional intermediate position disposed between the first and the second positions.

The additional spring may be configured not to bias the grip toward the first position over at least an additional non-biasing part of the stroke, the additional biasing part of the stroke being extending from the additional intermediate position, i.e., the end of the additional non-biasing part of the stroke.

The additional intermediate position may be different from the intermediate position.

The biasing part and the additional biasing part may overlap from the intermediate position or the additional intermediate position.

The resisting force resisting the pulling force generated by the springs may therefore be adapted to the desired sensation of the user. In addition, the spring and the additional spring may be smaller than the spring if the spring were the only spring.

According to one form of the present disclosure, the electronic handle comprises at least one damper configured to amortize shocks and noise when the grip is moved to the second position or when the grip is returned to the first position.

Thanks to the at least one damper, the noise and the shock are absorbed and the sensations of the user are improved.

Another form of the present disclosure is a vehicle door comprising an electronic handle according to any of the above-mentioned features.

According to one form of the present disclosure, the vehicle door comprises a first panel, a second panel, the first panel and the second panel forming internal door space, the bracket of the handle and the internal part of the grip of the handle being arranged inside the internal door space, the first panel comprising an internal surface delimiting the internal door space and an external surface opposed to the internal surface, the external part of the grip being arranged on the external surface of the first panel.

The grip may protrude from the external surface of the first panel, or be flushed on the external surface of the first panel.

Since the position of the grip is stabilized relative to the bracket and the vehicle door in the first configuration, non-esthetic gaps between an external part of the grip and an external surface of the door panel are reduced.

According to one form of the present disclosure, the vehicle door comprises a latch, the electronic handle being configured to cooperate with the latch to open the door.

According to one form of the present disclosure, in the first configuration, the electronic system is configured to cooperate with the latch to open the door when activated.

The electronic system is configured to cooperate with the latch electronically.

According to another form of the present disclosure, in the second configuration, the back-up system is configured to cooperate with the latch when activated.

When the grip is moved via a pulling force higher than the predetermined force, the back-up system may be activated mechanically. In addition to the above-mentioned advantages, the back-up system may therefore be independent from the main battery of the vehicle.

According to one form of the present disclosure, the first position of the grip corresponds to a retracted or rest position of the grip, and the second position of the grip corresponds to a deployed position of the grip.

Further advantages and advantageous features of the present disclosure are disclosed in the following description and in the dependent claims.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
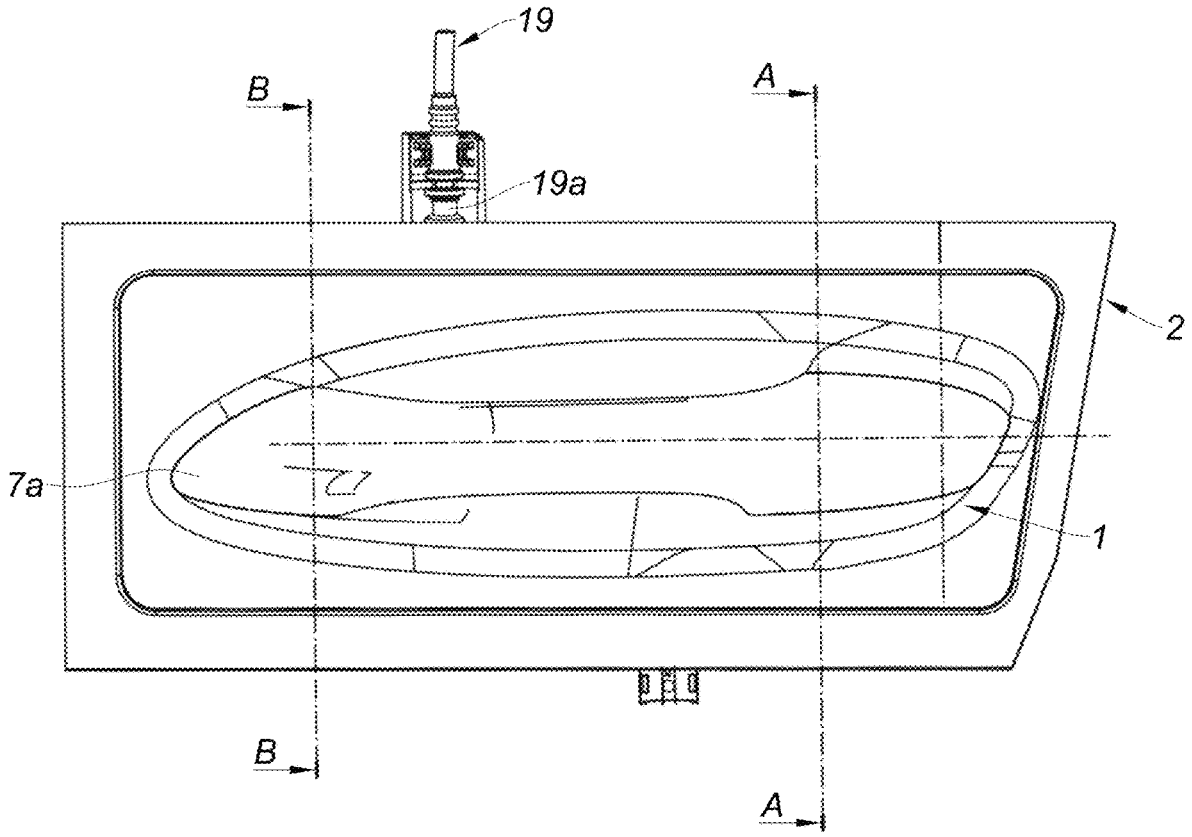
FIG. 1 is a front view showing the electronic handle, according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

In the following description, positioning terms such as front, back, left, right, etc., refer to an orthogonal basis comprising the following three directions: front-back, left-right and top-bottom. In this description, these three directions correspond to the usual directions attached to the motor vehicle. However, in other forms of the present disclosure, the directions front-back, left-right and top-bottom could be any set of arbitrary directions forming an orthogonal basis.

Figure 2:
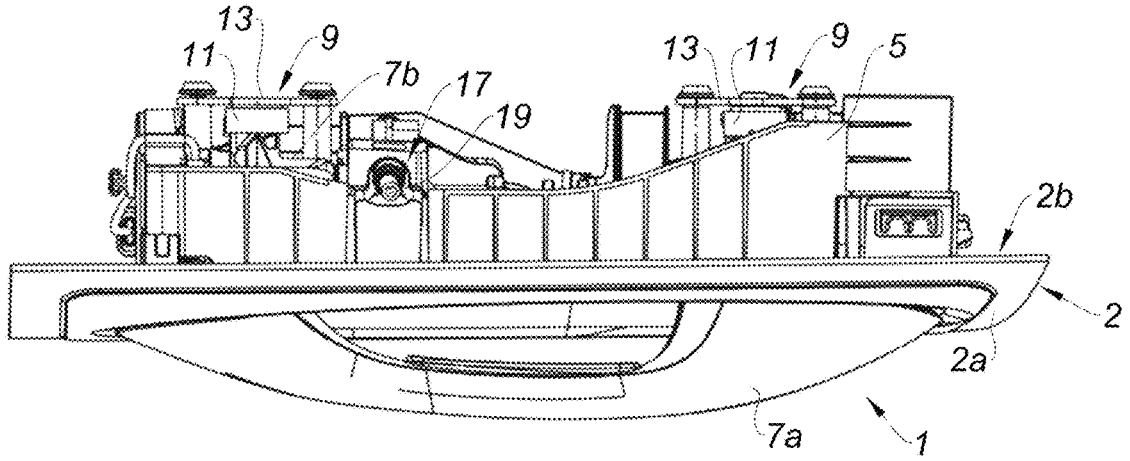
FIG. 2 is a top view showing the electronic handle, according to the teachings of the present disclosure.
Figure 3:
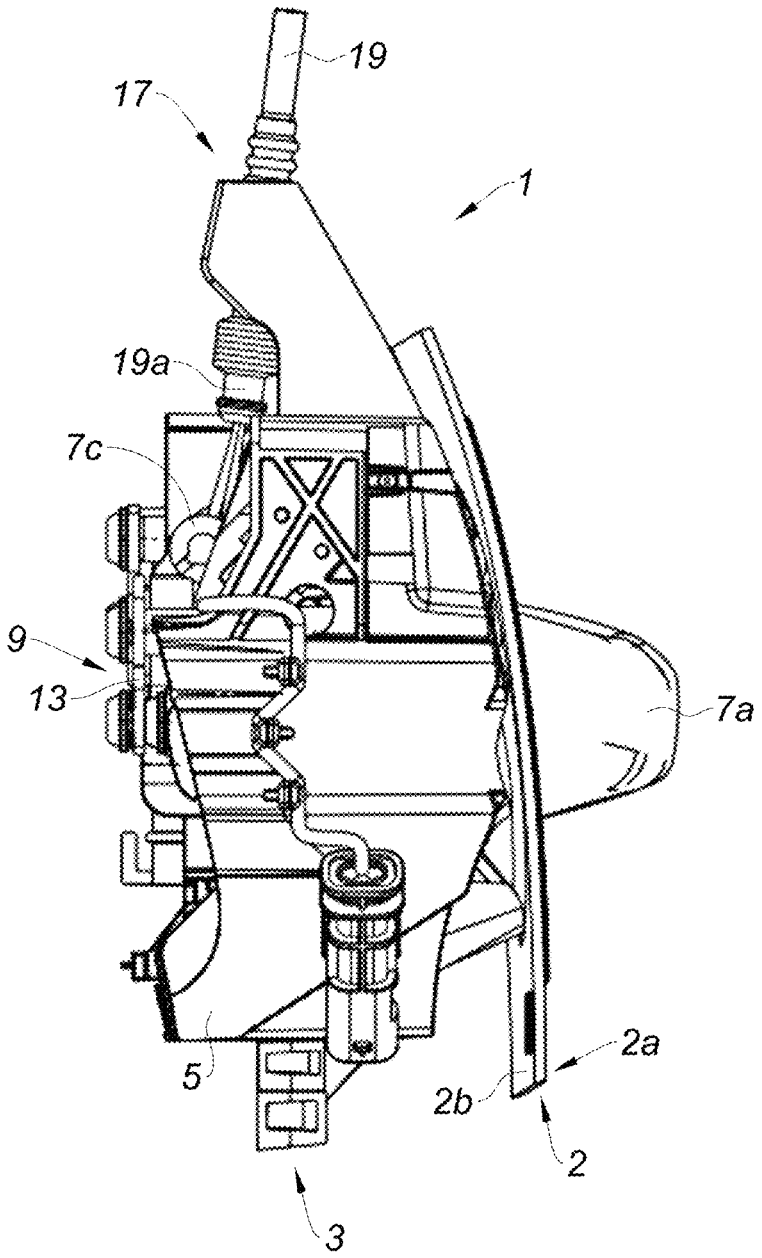
FIG. 3 is a side view showing the electronic handle, according to the teachings of the present disclosure.

Referring to FIGS. 1, 2, and 3, the electronic handle 1 is mounted on a vehicle door. The vehicle door comprises a first panel 2 and a second panel (not shown). The first and second panels are facing each other. The first and second panels are forming an internal door space 3. In this form, the first panel 2 is an external panel, i.e. arranged outside the vehicle, and the second panel is an internal panel, i.e. arranged inside the vehicle. In other forms, the first panel 2 may be an internal panel, and the second panel may be an external panel. The electronic handle 1 is therefore adapted to be an external handle or an internal handle. The first panel 2 comprises an external surface 2*a* and an internal surface 2*b*. The internal surface 2*b* partially defines the internal door space 3 and the external surface 2*a* is opposite to the internal surface 2*b*.

The electronic handle 1 comprises a bracket 5 arranged inside the internal door space 3, and a grip 7. In this form, the grip 7 at least partially protrudes from the external surface 2*a* of the first panel 2. In another form, the grip 7 may be flushed on the external surface 2*a* of the first panel 2.

Figure 4:
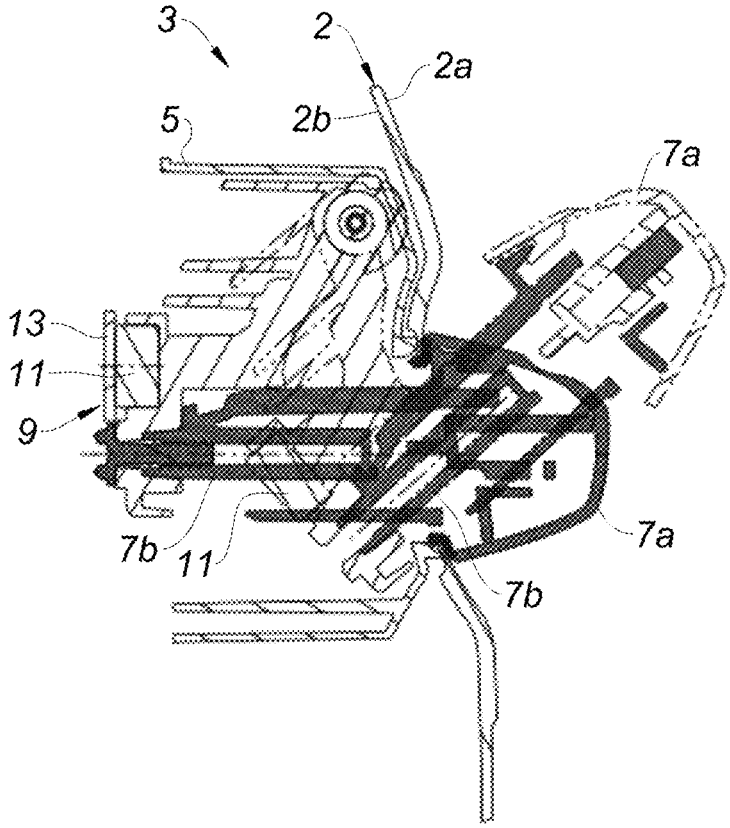
FIG. 4 is a cross-sectional view according to section A-A shown on FIG. 1 wherein the grip is shown in the first position and the second position.
Figure 5:
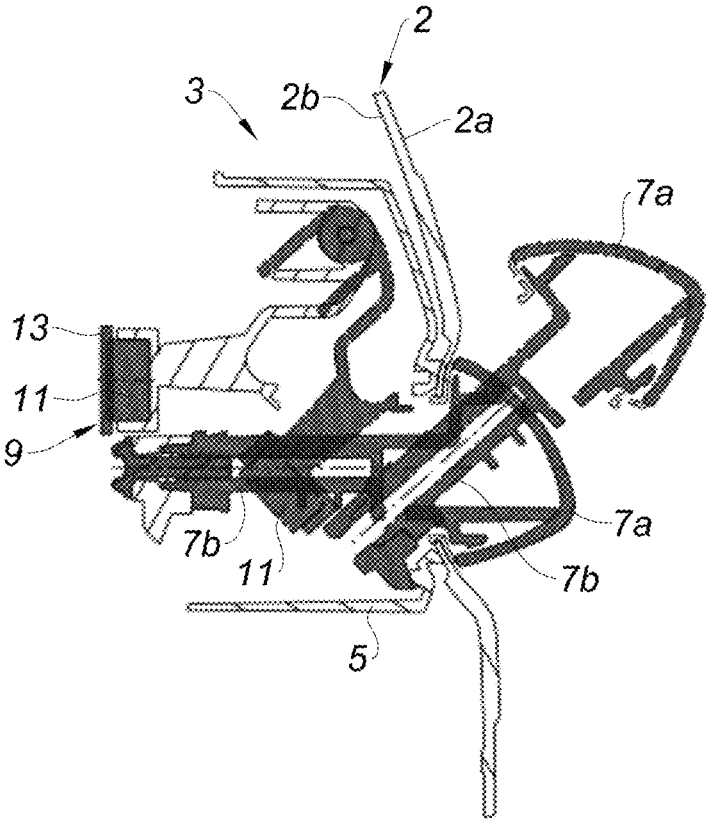
FIG. 5 is a cross-sectional view according to section B-B shown on FIG. 1 wherein the grip is shown in the first position and the second position.
Figure 6:
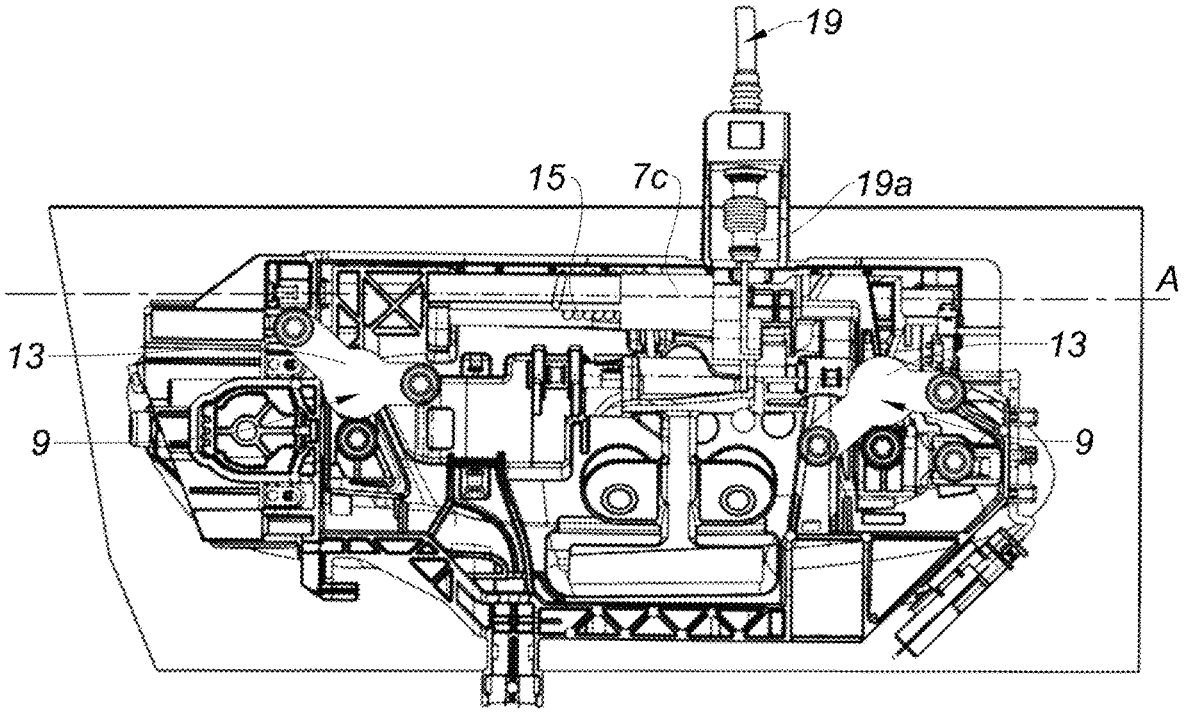
FIG. 6 is a back view showing the electronic handle, according to the teachings of the present disclosure.

Referring to FIGS. 4 and 5, the grip 7 is moveably mounted on the bracket 5. The grip 7 can be moved between a first position (FP) and a second position (SP). In FIGS. 4 and 5, the first position (FP) is represented in solid lines and the second position (SP) is represented by dotted lines. In this form, the grip 7 is rotatable relative to the bracket 5 around an axis of rotation A, shown in FIG. 6.

In this form, the axis of rotation A of the grip 7 extends in the front-back direction. In other forms, the axis of rotation of the grip 7 may extend in the left-right direction.

The grip 7 can be moved on a stroke S from the first position (FP) to the second position (SP) when a pulling force is applied on the grip 7 by a user. Indeed, the grip 7 is intended to be grasp by a user to open the door.

The grip 7 comprises an external part 7*a*, arranged on the external surface 2*a* of the first panel 2 of the vehicle door, a connecting part 7*b* affixed to the external part 7*a*, and an internal part 7*c*, affixed to the connecting part and rotatably mounted on the bracket 5. The internal part 7*c* of the grip 7 and the bracket 5 may be connected via a pivot bearing. The internal part 7*c* is arranged inside the internal door space 3.

In this form, the electronic handle 1 further comprises two magnetic retainers 9, configured to hold the grip 7 in the first position (FP) when a pulling force applied on the grip 7 by a user is lower that a predetermined force corresponding to a magnetic force generated by the magnetic retainers 9. The magnetic retainers 9 are also configured to release the grip 7 and allow a movement from the first position (FP) to the second position (SP) in response to a pulling force applied on the grip 7 by the user that is higher than the predetermined force.

One magnetic retainer 9 will be described here below. The reference numbers concerning the described magnetic retainer apply to the other magnetic retainer.

In this form, the magnetic retainer 9 comprises a magnetic element, such as a magnet 11, and a ferromagnetic element 13. In this form, the magnet 11 is affixed to the connecting part 7*b* of the grip 7 and the ferromagnetic element 13 is affixed to the bracket 5, for example by screws or any other affixing approach known by the skilled person. In another form, the magnet 11 is affixed to the bracket 5, and the ferromagnetic element 13 affixed to the connecting part 7*b* of the grip 7, for example by screws or any other affixing approach known by the skilled person. Therefore, the connecting part 7*b* of the grip 7 is attached to the bracket 5 at via the magnetic retainer 9. Indeed, the magnetic retainer 9 may be arranged the closest to the applied pulling force to increase its efficiency.

In another form, the magnetic retainer 9 may comprise an electromagnetic member, such as an electromagnet, configured to generate a magnetic force corresponding to the predetermined force.

In this form, the predetermined force is 150N.

Since two magnets 11 are used in this form, each of the magnet may generate half the predetermined force. For example, each of the magnets 11 generate a force of 75N.

In other forms, the magnetic retainer 9 may comprise only one magnet, or several magnets, for example three or five magnets. In case the magnetic retainer 9 comprises several magnets, the sum of the magnetic forces generated by each magnets correspond to the predetermined force, i.e. in this form, 150N.

The magnet 11 may the cylindrical. The diameter of the cylinder may be between 10 and 20 mm. In this form, the diameter of the cylinder is 15 mm. The height of the cylinder may be between 5 and 10 mm. In this form, the height of the cylinder is 8 mm. The dimensions of the magnet 11 are adapted to the desired magnetic force it generates. In other forms, the magnet 11 may have any other suitable forms.

The ferromagnetic element 13 may be a ferromagnetic plate screwed to the bracket 5. The ferromagnetic element 13 may be made of steel or pure iron for example. The ferromagnetic plate may have a thickness comprised between 1 and 3 mm. In this form, the thickness of the ferromagnetic plate is 2 mm. In other forms, the ferromagnetic element 13 may have any other suitable forms.

The electronic handle 1 may comprise at least one spring 15, 16 configured to bias the grip 7 toward the first position when the grip 7 is moving from the first position (FP) to the second position (SP). The at least one spring 15, 16 may be mounted between the internal part 7*c* of the grip 7 and the bracket 5. For example, the at least one spring 15, 16 is mounted in the pivot bearing.

Figure 7:
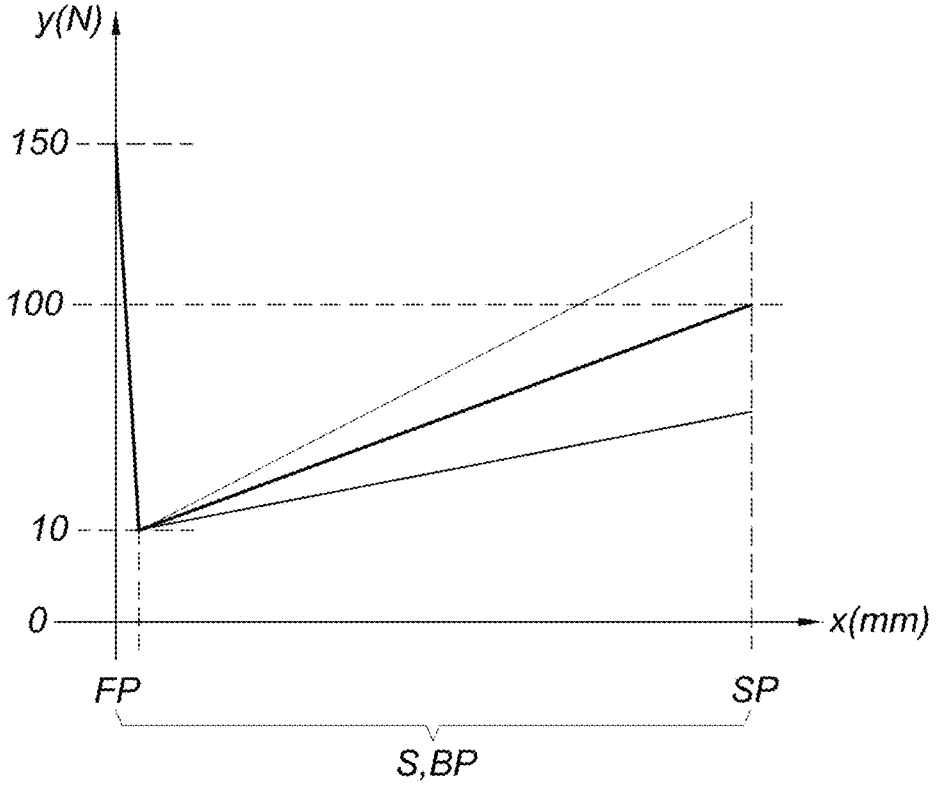
FIG. 7 is a diagram showing the forces applied on the grip relative to the stroke of the grip according to one form of the present disclosure.
Figure 8:
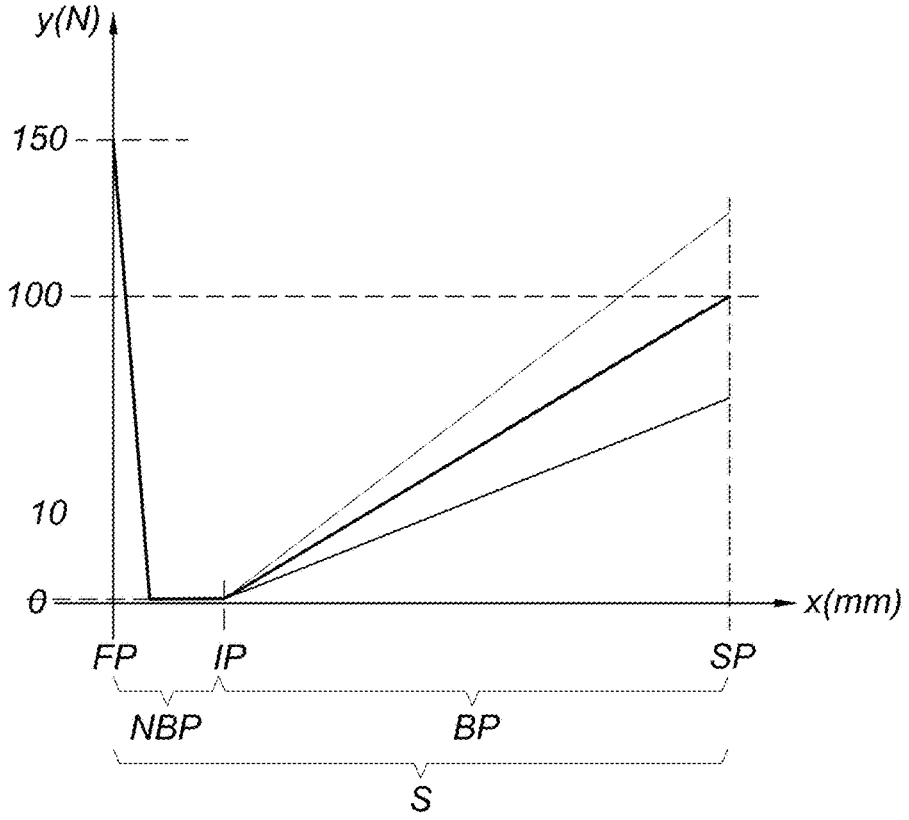
FIG. 8 is a diagram showing the forces applied on the grip relative to the stroke of the grip according to another form of the present disclosure.
Figure 9:
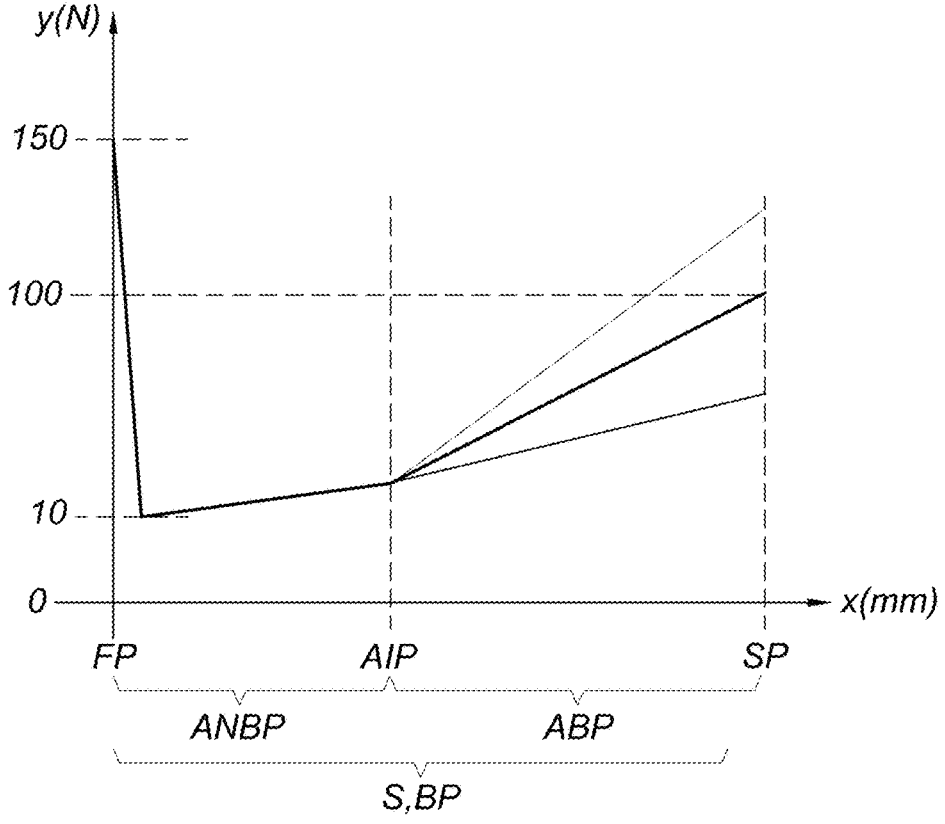
FIG. 9 is a diagram showing the forces applied on the grip relative to the stroke of the grip according to another form of the present disclosure.

FIGS. 7 to 9 represent diagrams showing the forces resisting the pulling force applied on the grip 7 during the stroke S of the grip 7 from the first position (FP) to the second position (SP).

In one form represented in FIG. 7, the electronic handle 1 comprises one spring 15. The spring 15 is in a rest position or in a working position. In the working position, the spring 15 is configured to bias the grip 7 toward the first position (FP). In other words, in the working position, the spring 15 is configured to resist the pulling force applied on the grip 7 by the user. The spring 15 is in the working position, and therefore biases the grip 7 toward the first position (FP), over at least one biasing part (BP) of the stroke S of the grip 7.

In the form represented on FIG. 7, the biasing part (BP) extends from the first position (FP) to the second position (SP), i.e. the spring 15 is in the working position, biasing the grip 7 toward the first position (FP), over the entire stroke S of the grip 7. In other words, the biasing part (BP) of the stroke S corresponds to the entire stroke S of the grip 7. As shown on FIG. 7, the biasing force resisting the pulling force increases from the first position (FP) to the second position (SP). According to a first alternative of this form, the spring 15 may start biasing the grip 7 toward the first position (FP) when the grip 7 starts being moved from the first position (FP) to the second position (SP), i.e. the biasing force at the first position (FP) may be proximate to 0 Newtons. According to a second alternative of this form, the spring 15 may already be applying a biasing force to the grip 7 when the grip 7 is in the first position (FP), i.e. before the grip 7 starts moving toward the second position (SP).

As depicted on FIG. 7, when a pulling force higher than the predetermined force, i.e. 150N in this form, is applied on the grip 7, the magnetic force holding the grip 7 in the first position (FP) decreases, and the grip 7 starts its stroke S from the first position (FP) to the second position (SP). At the same time, the spring 15 biases the grip 7 toward the first position (FP) with a biasing force that increases. Until the biasing force and the magnetic force reach the same value, 10N in this example, the resisting force resisting the pulling force is the magnetic force generated by the magnetic retainer 9. After the magnetic force and the biasing force have reached the same value, 10N in this example, the resisting force resisting the pulling force is the biasing force, generated by the spring 15. The biasing force continues increasing to reach its maximum value at the end of the stroke of the grip 7, i.e. when the grip 7 reaches the second position (SP).

The maximum value of the biasing force is defined by the type of spring 15 mounted in the electronic handle 1. As depicted on FIG. 7, the maximum value of the biasing force may be, for example, between 75N and 125N.

Another form is represented on FIG. 8. The form represented on FIG. 8 differs from the form represented on FIG. 7 in that the biasing part (BP) of the stroke S may extend from an intermediate position (IP), disposed between the first position and second positions (SP). The part of the stroke S that is between the first position (FP) and the intermediate position (IP), is a non-biasing part (NBP) of the stroke S, i.e., in which the spring 15 is in the rest position, not biasing the grip 7. In other words, the spring 15 is moved to the working position after the grip 7 has completed the non-biasing part (NBP) of the stroke S. For example, the non-biasing part (NBP) of the stroke S represent at least 15% of the stroke S between the first position (FP) and the second position (SP).

Another form is represented on FIG. 9. The form represented on FIG. 9 differs from the forms represented on FIGS. 7 and 8 in that the electronic handle 1 comprises an additional spring 16. Similar to the spring 15, the additional spring 16 is configured to bias the grip 7 toward the first position (FP) over an additional biasing part (ABP) of the stroke S. The additional spring 16 may also be configured not to bias the grip 7 toward the first position (FP) over an additional non-biasing part (ANBP) of the stroke S.

The additional non-biasing part (ANBP) may extend from the first position (FP) to an additional intermediate position (AIP), disposed between the first position (FP) and the second position (SP). The additional biasing part (ABP) may extend from the additional intermediate position (AIP) to the second position (SP).

In the form shown in FIG. 9, the biasing part (BP) of the stroke S, i.e. when the spring 15 is biasing the grip 7 toward the first position (FP), extends from the first position (FP), i.e. the biasing part (BP) corresponds to the entire stroke S. In the form shown in FIG. 9, the additional non-biasing part (ANBP) extends from the first position (FP) to the additional intermediate position (AIP). For example, at the additional intermediate position (AIP), the grip 7 has completed at least 15% of the stroke S. In one form, at the additional intermediate position (AIP), the grip 7 has completed at least 30% of the stroke S.

In this form, the biasing part (BP) and the additional biasing part (ABP) overlap from the additional intermediate position (AIP) to the second position (SP). Therefore, the biasing force of the spring 15 and the biasing force of the additional spring 16 are added over the additional biasing part (ABP).

As shown in FIG. 9, the sum of the biasing forces of the spring 15 and the additional spring 16 reaches a value between 75 and 125N. Therefore, the spring 15 and the additional spring 16 may be smaller, in this form, than they are in the forms depicted on FIGS. 7 and 8.

In other forms, the additional biasing part (ABP) may extend from the first position (FP). In this case, the additional non-biasing part (ANBP) does not exist, and the biasing part (BP) and the additional biasing part (ABP) may overlap over the entire stroke S.

In other forms, the biasing part (BP) may extend from the intermediate position (IP), and the additional biasing part (ABP) may extend from the additional intermediate position (AIP). The intermediate position (IP) and the additional intermediate position (AIP) may be different. Alternatively, the intermediate position (IP) and the additional intermediate position (AIP) may be the same position. These positions may be adapted to the desired sensation by the user.

The electronic handle 1 further comprises an electronic system configured to electronically cooperate with a latch for opening the vehicle door when activated in a first configuration corresponding to a normal use. The electronic system is configured to activate in response to a detection of a pulling force applied on the grip 7 that is lower than the predetermined force. Therefore, in the first configuration, the grip 7 stays in the first position (FP). For example, the range of the pulling force is from 0 Newtons to the value of the predetermined force. Therefore, only the presence of the hand of the user on the grip 7 allows the opening of the door.

In the first configuration, when the electronic system is activated, the vehicle door may be opened via an electronic signal.

The electronic system may comprise a pulling force sensor, for example arranged in the external part 7*a* of grip 7. The electronic system may also comprise a transmitter, configured to communicate with the sensor. When the sensor detects a pulling force, the transmitter may send a signal to a receiver of the latch to open the vehicle door. The signal may be transmitted via a wire or wirelessly.

The electronic handle 1 further comprises a back-up system 17 configured to cooperate with the latch for opening the vehicle door when activated in a second configuration corresponding to an emergency or a lack of electrical power. The back-up system 17 is activated when the grip 7 is moved from the first position (FP) to the second position (SP).

In this form, in the second configuration, when the back-up system 17 is activated, the vehicle door may be opened mechanically. The back-up system may comprise a transmitting element, such as a cable 19 or a rod linked, to the internal part 7*c* of grip 7 on one end 19*a*, and to the latch on the other end. Therefore, when the grip 7 is moved from the first position (FP) to the second position (SP), the internal part 7*c* of the grip 7 rotates, and therefore pulls the cable 19 to activate the latch and open the vehicle door. The movement of the grip 7 from the first position (FP) to the second position (SP), may also allow to uncover a lock, that may be arranged below the grip when the grip 7 is in the first position (FP). The user can unlock the door with a back-up key. An advantage of this configuration is that the user will intuitively understand that an action is needed to unlock the door, and the introduction of the back-up key into the lock is eased.

In other forms, when the back-up system 17 is activated, the vehicle door may be opened electrically, using an emergency battery, disconnected from the main vehicle battery. In this case, the magnetic retainer 9 may comprise an electro-magnet instead of a magnet.

Thanks to the magnetic retainer 9, the position of the grip 7 is stabilized relative to the bracket 5 and to the vehicle door in the first configuration, in normal use. In addition, thanks to the magnetic retainer 9, in the first configuration, an external part 7*a* of the grip 7 is retained closely to the external surface 2*a* of the first panel 2. Non-esthetic gaps between the external part 7*a* of the grip 7 may therefore be reduced in the first configuration.

The position of the grip 7 is also stabilized relative to the bracket 5 and the vehicle door in the second configuration when not activated, i.e. during a crash, the door of the vehicle does not open. Indeed, when the pulling force applied on the grip 7 does not exceed the predetermined force, the grip 7 does not move and is therefore stable.

After a crash or in case of a lack of electrical power, the user can open the vehicle door by pulling the grip 7 with a force that exceed the predetermined force. Therefore, the position of the grip is stabilized in case of a normal use and when not activated, but can easily be moved to open the vehicle door.

In addition, in case the door is locked, the user may access the lock to unlock the door with a back-up key when the grip 7 is in the second position.

In the first configuration, the magnetic retainer 9 holds the grip in the first position (FP) when a pulling force lower that the predetermined force is applied on the grip 7. Therefore, the electronic system is activated without the grip 7 being moved, whereas in the second configuration, the back-up system is activated by the displacement of the grip 7 from the first position (FP) to the second position (SP).

In addition, the electronic handle 1 may comprise dampers configured to amortize shocks and noise when the grip 7 is moved to the second position (SP) or when the grip 7 is returned to the first position (FP).

The disclosure is not limited to the forms described above by way of examples but it rather comprises all the technical equivalents and variants of the approaches described as well as their combinations.

It is to be understood that the present disclosure is not limited to the forms described above and illustrated in the drawings. Rather, the skilled person will recognize that many changes and modifications may be made within the scope of the appended present disclosure.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An electronic handle for a vehicle door, the electronic handle comprising:

a bracket;

a grip movably mounted on the bracket between a first position and a second position, the grip configured to move from the first position to the second position when a pulling force is applied on the grip by a user;

a magnetic retainer configured to hold the grip in the first position when no pulling force is applied on the grip;

an electronic system configured to electronically cooperate with a latch for opening the vehicle door when activated in a first configuration corresponding to a normal use; and a back-up system configured to cooperate with the latch for opening the vehicle door when activated in a second configuration corresponding to an emergency or a lack of electrical power, wherein the electronic system is configured to activate in response to a detection of the pulling force applied on the grip that is lower than a predetermined force, and wherein the magnetic retainer is configured to hold the grip in the first position if the pulling force applied on the grip is lower than the predetermined force and to release the grip, allowing a movement from the first position to the second position to activate the back-up system, if the pulling force applied on the grip is higher than the predetermined force.

2. The electronic handle according to claim 1, wherein the predetermined force is between 50 and 700 Newtons.

3. The electronic handle according to claim 1, wherein the magnetic retainer comprises a magnetic element.

4. The electronic handle according to claim 3, wherein the magnetic element is one of a magnet and a ferromagnetic element.

5. The electronic handle according to claim 1, wherein the grip comprises:

an external part, arranged on an external surface of the vehicle door; and a connecting part affixed to the external part, the connecting part affixed to the bracket via the magnetic retainer when the grip is in the first position.

6. The electronic handle according to claim 5, wherein the grip comprises an internal part affixed to the connecting part, the internal part rotatably mounted on the bracket, wherein the internal part rotates relative to the bracket when the grip is moved from the first position to the second position.

7. The electronic handle according to claim 1, wherein the grip is configured to move on a stroke between the first position and the second position and wherein the electronic handle comprises at least one spring configured to bias the grip toward the first position over at least a biasing part of the stroke.

8. The electronic handle according to claim 7, wherein the biasing part of the stroke extends from the first position.

9. The electronic handle according to claim 7, wherein the biasing part of the stroke extends from an intermediate position of the stroke, the intermediate position disposed between the first and the second positions.

10. A vehicle door comprising an electronic handle according to claim 1.

11. The vehicle door according to claim 10, further comprising a first panel, and a second panel, wherein the first panel and the second panel form an internal door space, the bracket of the electronic handle and an internal part of the grip of the electronic handle being arranged inside the internal door space, the first panel comprising an internal surface delimiting the internal door space and an external surface opposed to the internal surface, and an external part of the grip being arranged on the external surface of the first panel.

12. The vehicle door according to claim 10 further comprising the latch, wherein the electronic handle is configured to cooperate with the latch to open the vehicle door.

13. The vehicle door according to claim 12, wherein, in the first configuration, the electronic system is configured to cooperate with the latch to open the vehicle door when activated.

14. The vehicle door according claim 12, wherein, in the second configuration, the back-up system is configured to cooperate with the latch when activated.

15. The electronic handle according to claim 1, wherein the detection of the pulling force applied on the grip occurs for all force values that are greater than zero newtons and lower than the predetermined force.

16. The electronic handle according to claim 15, wherein the electronic system includes a pulling force sensor configured to detect a force value of the pulling force, wherein the electronic system is configured to compare the force value to the predetermined force.

17. The electronic handle according to claim 1, wherein the electronic system includes a pulling force sensor configured to detect a force value of the pulling force, wherein the electronic system is configured to compare the force value to the predetermined force.

* * * * *